US011519139B2

(12) United States Patent
Cottingham

(10) Patent No.: US 11,519,139 B2
(45) Date of Patent: Dec. 6, 2022

(54) HEATING APPARATUS

(71) Applicant: J.C. BAMFORD EXCAVATORS LIMITED, Uttoxeter (GB)

(72) Inventor: Darryl Cottingham, Uttoxeter (GB)

(73) Assignee: J.C. BAMFORD EXCAVATORS LIMITED, Uttoxeter (GB)

( * ) Notice: Subject to any disclaimer, the term of this patent is extended or adjusted under 35 U.S.C. 154(b) by 0 days.

(21) Appl. No.: 16/936,374

(22) Filed: Jul. 22, 2020

(65) Prior Publication Data

US 2021/0071372 A1 Mar. 11, 2021

(30) Foreign Application Priority Data

Jul. 22, 2019 (GB) ..... 1910461

(51) Int. Cl.
*E01C 23/00* (2006.01)
*E01C 23/06* (2006.01)
*F23D 14/12* (2006.01)

(52) U.S. Cl.
CPC ..... *E01C 23/065* (2013.01); *F23D 14/12* (2013.01)

(58) Field of Classification Search
CPC ..... E21C 23/065; F23D 14/12
USPC ..... 404/72, 75, 77, 79, 95, 117
See application file for complete search history.

(56) References Cited

U.S. PATENT DOCUMENTS 3,066,582 A * 12/1962 Cutler ..... E01C 23/065 404/95
3,989,401 A * 11/1976 Moench ..... E01C 23/14 404/90
4,545,700 A 10/1985 Yates
4,714,374 A 12/1987 Mihara
4,793,730 A * 12/1988 Butch ..... E01C 23/065 404/91
5,472,292 A * 12/1995 Wiley ..... E01C 23/065 404/79
5,484,224 A * 1/1996 Lynch ..... E01C 23/065 404/77
6,371,689 B1 * 4/2002 Wiley ..... E01C 23/065 404/77
7,874,763 B2 * 1/2011 Benedetti ..... E01C 23/14 404/95
8,137,025 B2 * 3/2012 Wiley ..... E01C 23/065 404/77

(Continued)

FOREIGN PATENT DOCUMENTS

CN 102852082 A 1/2013
CN 207973978 U 10/2018

(Continued)

OTHER PUBLICATIONS

Search Report issued in GB 1910461.1, dated Jan. 16, 2020.
Extended European Search Report for European Patent Application No. 20186987.2, dated Nov. 26, 2020.

*Primary Examiner* — Raymond W Addie
(74) *Attorney, Agent, or Firm* — Marshall, Gerstein & Borun LLP

(57) ABSTRACT

An apparatus is provided for heating a road surface material to be repaired. The apparatus includes a frame and a heater connected to the frame so as to be positioned over a road surface, in use, for heating for heating a road surface material. An agitator is also connected to the frame for agitating a road surface material. The agitator is configured to agitate road surface material heated by the heater.

13 Claims, 6 Drawing Sheets

(56) References Cited

U.S. PATENT DOCUMENTS

| | | | | |
|---|---|---|---|---|
| 2003/0026656 | A1* | 2/2003 | Crupi | E01C 23/065 404/77 |
| 2005/0175412 | A1* | 8/2005 | Lloyd | E01C 23/065 404/77 |
| 2008/0193214 | A1* | 8/2008 | Hall | E01C 23/065 404/75 |
| 2009/0226254 | A1* | 9/2009 | Jones | E01C 23/14 404/77 |
| 2010/0074684 | A1 | 3/2010 | Stockwell et al. | |
| 2014/0050526 | A1* | 2/2014 | Rees | E01C 23/06 404/93 |
| 2017/0130408 | A1 | 5/2017 | Zhang et al. | |

FOREIGN PATENT DOCUMENTS

| | | | |
|---|---|---|---|
| GB | 2392190 | A | 2/2004 |
| KR | 2001 0002232 | A | 1/2001 |
| WO | WO-93/17185 | A1 | 9/1993 |

* cited by examiner

HEATING APPARATUS

FIELD OF THE INVENTION

The present invention relates to a heating apparatus, and to a working machine having a heating apparatus mounted thereto.

BACKGROUND OF THE INVENTION

Over time and through continued use roads can become worn and damaged, resulting in the formation of potholes in the road surface. The surface damage may be caused by water weakening the underlying soil structure and traffic passing over the affected area degrades and breaks the poorly supported road surface. Alternating cycles of freezing and thawing can also damage the road surface. When water enters the road surface it can freeze and expand, as the ice thaws it leaves cracks in the road surface, subsequently allowing more liquid water into the road surface. Eventually, large section of the road surface may break away. Large sums of money are spent each year on routine maintenance and repair of roads to counter this degradation of the road surface.

Traditionally, this repair has been carried out by planing an area of the road surface, removing said planed material, and depositing fresh road surface material to replace the removed material. This method is quite expensive due to the large amount of fresh road surface material required for each repair. An alternative approach has been to jet replacement road surface material directly into the pothole. Whilst this method is relatively low in cost and time, it results in a poor surface finish, and adhesion to the existing road surface is poor, which means it is only a short term solution.

Increasingly, the industry is using what is known as a thermal repair method to repair potholes in the road surface. This method involves heating the existing road surface, before filing the pothole with replacement road surface material. However, the time required to heat the existing road surface has resulted in this method being very time intensive.

The present invention seeks to overcome or at least mitigate one or more problems associated with the prior art.

SUMMARY OF THE INVENTION

A first aspect of the invention provides an apparatus for heating a road surface material to be repaired, the apparatus comprising: a frame; a heater connected to the frame and arranged to be positioned over a road surface, in use, for heating a road surface material; and an agitator connected to the frame, the agitator configured to agitate a road surface material, wherein, in use, the agitator is configured to agitate road surface material heated by the heater.

Typically, when heating a road surface for repair, it takes around 8-10 minutes to heat a road surface material to a uniform desired temperature (e.g. 150° C.) due to the time taken for the heat to travel through the road material to the material beneath the upper surface.

Prior to repairing a road surface, the road surface will be planed in order to loosen the road surface material. The present apparatus is able to heat the road surface material whilst agitating the road surface material (i.e. to bring up material beneath the upper surface towards the surface).

This agitation, e.g. by extending into an disrupting the road surface, mixes the different layers of road surface material, which improves the efficiency of the heating process by providing a more uniform heating of the different layers of material. This has been found to reduce time required to heat the road surface material, which in turn reduces the length of time required to repair in a road surface (e.g. to repair a pothole in a road surface).

The agitator may be configured to agitate road surface material as said road surface material is heated by the heater.

This simultaneous heating and agitation of the road surface material has been found to further improve uniform heating of the road surface material, which in turn reduces the length of time required to repair in a road surface.

The heating apparatus may be configured to heat the agitator.

The road surface, e.g. asphalt, would typically stick to the surface of a cool agitator (e.g. a steel agitator). Heating the agitator, e.g. prior to it interacting with the road surface material, helps to reduce sticking of road surface material to the agitator as it interacting with the road surface.

The agitator may be arranged to be interposed between the heater and the road surface, in use, such that the heater is configured to heat the agitator and a road surface material.

This arrangement allows the heater to heat both the agitator and the road surface at the same time, removing the need for a separate agitator heating system.

The agitator may be connected to the frame so as to be moveable between a first position in which the agitator is able to interact with a road surface material, in use, and a second position in which the agitator is spaced apart from, and unable to interact with, the road surface material, in use.

With this arrangement, an operator is able to transport the heating apparatus into position with the agitator in the second, e.g. raised, position. The operator is then able to lower the agitator when the heating apparatus is in position, e.g. after the agitator has been heated, so as to interact with the road surface material to be repaired.

The agitator may comprise one or more rotatable members mounted to the frame.

Each rotatable member may be configured to rotate relative to the frame at a rate in the range of 5-100 RPM, e.g. at a rate in the range of 20-30 RPM.

Providing a rotating agitator has been found to provide a compact arrangement for the heating apparatus. Additionally, rotating the agitator at these rotational speeds has been found to optimize heating of the road surface material.

Each of the one or more rotatable members may comprise one or more projections, e.g. teeth, paddles, or a helical fin, configured and arranged to extend into and agitate a road surface material, in use.

The heater may define a heating area over which heat is applied to a road surface material, in use.

The one or more rotatable members may be arranged in an array over said heating area.

This arrangement increases the area of the road surface material that is agitated at once during the heating process, thus further reducing the time required to heat the road surface.

The agitator may be configured to interact with and agitate a road surface material to a depth of approximately 160 mm below an upper road surface, optionally 120 mm below an upper road surface, e.g. 40 mm below an upper road surface.

The apparatus may comprise a milling device connected to the frame and configured to break up a road surface, in use.

This arrangement provides a compact single unit that is able to i) break up a road surface, and ii) heat/agitate the broken up loose road surface material.

The milling device may be configured to break up a road surface down to a depth of approximately 160 mm below an upper road surface, optionally 120 mm below an upper road surface, e.g. 40 mm below an upper road surface.

The milling device may comprise a planer connected to the frame.

The heater may comprise an infrared or microwave heater.

The heater may be a gas powered heater.

This type of heater has been found to increase the efficiency of the heating apparatus compared to convection heaters. Moreover, this has been found to provide an efficient way to heat the road surface and the agitator simultaneously.

The apparatus may comprise a control system configured to control activation of the heater.

The control system may be configured to activate the heater periodically.

Periodic operation of the heater has been found to reduce damage to the road surface material by mitigating burning of said material, whilst allowing time for the heat to be absorbed and penetrate into the road surface.

The apparatus may comprise a sensor for sensing the distance between the heater and a road surface, in use. The control system may be configured to activate the heater when the distance between the heater and a road surface is below a predetermined threshold.

The apparatus may comprise a receptacle for storing replacement road surface material, e.g. asphalt, therein. The receptacle may be configured to deposit said replacement road surface material onto a road surface, in use.

The heating apparatus may be configured to agitate, e.g. mix, the deposited replacement road surface material and the road surface material, in use.

This improves mixing of the existing and replacement road surface, which has been found to improve bonding of the repaired road surface area to the rest of the road.

Through this agitation, the heating apparatus is configured to substantially level the road surface area prior to compaction (e.g. with a roller), which removes the need for a separate leveller to be used.

The agitator may be configured to agitate, e.g. mix, the deposited replacement road surface material and the road surface material, in use.

The apparatus may comprise a mixing member configured and arranged to extend into and agitate the deposited replacement road surface material and the road surface material, in use.

The heating apparatus may be configured to heat the mixing member.

The road surface, e.g. asphalt, would typically stick to the surface of a cool mixing member. Heating the mixing member before it interacts with the road surface material helps to reduce sticking of road surface material to the mixing member.

The heater may define a substantially rectangular or square heating area having sides in the range of 0.3 m to 1.5 m, e.g. approximately 1 m, over which heat is applied to a road surface material, in use.

The heater may comprise an energy in the range of 200,000 BTU to 2,000,000 BTU.

The heater may be configured to heat the road surface material to an average temperature in the range of 50° C. to 200° C., e.g. 150° C., in less than 3 minutes, e.g. in less than 2 minutes, optionally in less than 1 minute.

The agitator may comprise a stainless material, e.g. stainless steel.

The apparatus may comprise a roller drum rotatable about an axis for travelling over and compacting a material of a road surface, in use.

This arrangement provides a compact single unit that is able to i) heat/agitate the planed road surface material and ii) compact the heated road surface material.

The apparatus may comprise a vibration assembly for imparting a vibratory force to the roller drum, in use.

The apparatus may be portable.

Providing a heating apparatus that is portable, e.g. mounted to a vehicle, provided on wheels etc., enables an operator to transport the heating apparatus to the road surface that needs to be heated/repaired.

The apparatus may comprise a mounting arrangement for mounting the heating apparatus to a working machine, e.g. to a working arm of a working machine.

According to a second aspect of the invention, there is provided a working machine comprising: a body; and a first working arm connected to the body for performing work functions, wherein an apparatus according to the first aspect is mounted to the first working arm.

According to a third aspect of the invention, there is provided a working machine comprising: a body; and a first working arm connected to the body for performing work functions; a second working arm connected to the body for performing work functions, wherein an apparatus for heating a road surface material to be repaired is mounted to the first working arm, the apparatus comprising a frame, a heater for heating a road surface material and connected to the frame such that it opposes a road surface material to be heated, in use, an agitator connected to the frame, the agitator configured to agitate a road surface material to be heated, and wherein a milling device for breaking up a road surface is mounted to the second working arm.

According to a fourth aspect of the invention, there is provided a working machine comprising: a body; and a first working arm connected to the body for performing work functions; wherein an apparatus for heating a road surface material to be repaired is mounted to the first working arm, the apparatus comprising a frame, a heater for heating a road surface material and connected to the frame such that it opposes a road surface material to be heated, in use, an agitator connected to the frame, the agitator configured to agitate a road surface material to be heated, and a receptacle for storing replacement road surface material, e.g. asphalt, to be deposited onto a road surface, in use, wherein, in use, the apparatus is configured such that the agitator is configured to agitate a road surface material as the heater is heating said road surface material.

The working machine may comprise a second working arm connected to the body for performing work functions.

A milling device for breaking up a road surface may be mounted to the second working arm.

The working machine may comprise a roller drum rotatable about an axis for travelling over and compacting a material of a road surface, in use.

The roller drum may be mounted to the apparatus for heating a road surface.

According to a fifth aspect of the invention, there is provided a working machine comprising: a body; and a first working arm connected to the body for performing work functions; wherein an apparatus for heating a road surface material to be repaired is mounted to the first working arm, the apparatus comprising a frame, a heater for heating a road surface material and connected to frame such that it opposes a road surface material to be heated, in use, an agitator connected to the frame, the agitator configured to agitate a road surface material to be heated, and a milling device connected to the frame, the milling device configured for breaking up a road surface, wherein, in use, the heating apparatus is configured such that the agitator is configured to agitate a road surface material as the heater is heating said road surface material.

The apparatus may comprise a receptacle for storing replacement road surface material, e.g. asphalt.

The receptacle may be configured to deposit said replacement road surface material onto a road surface.

The working machine may comprise a second working arm connected to the body for performing work functions A roller drum may be mounted to the second working arm, the roller drum being rotatable about an axis for travelling over and compacting a material of a road surface, in use.

The working machine of the second, third, fourth and fifth aspects may be an excavator, a loader, or a telehandler.

According to a sixth aspect of the invention, there is provided a method of repairing a road surface using an apparatus according to the first aspect, or the working machine according to any one of the second, third, fourth or fifth aspects, the method comprising the steps of: a) heating a road surface to be repaired with the heater; b), at the same time as step a), agitating a road surface material as the heater is heating said road surface material.

The method may comprise step c) before step a) of breaking up a road surface material with a milling device.

The method may comprise step d) after step b) of depositing replacement road surface material onto a road surface.

The method may comprise step e) of mixing the replacement road surface material with the road surface material.

BRIEF DESCRIPTION OF THE DRAWINGS

Embodiments of the invention will now be described with reference to the accompanying drawings, in which.

DETAILED DESCRIPTION OF EMBODIMENT(S)

Figure 1:
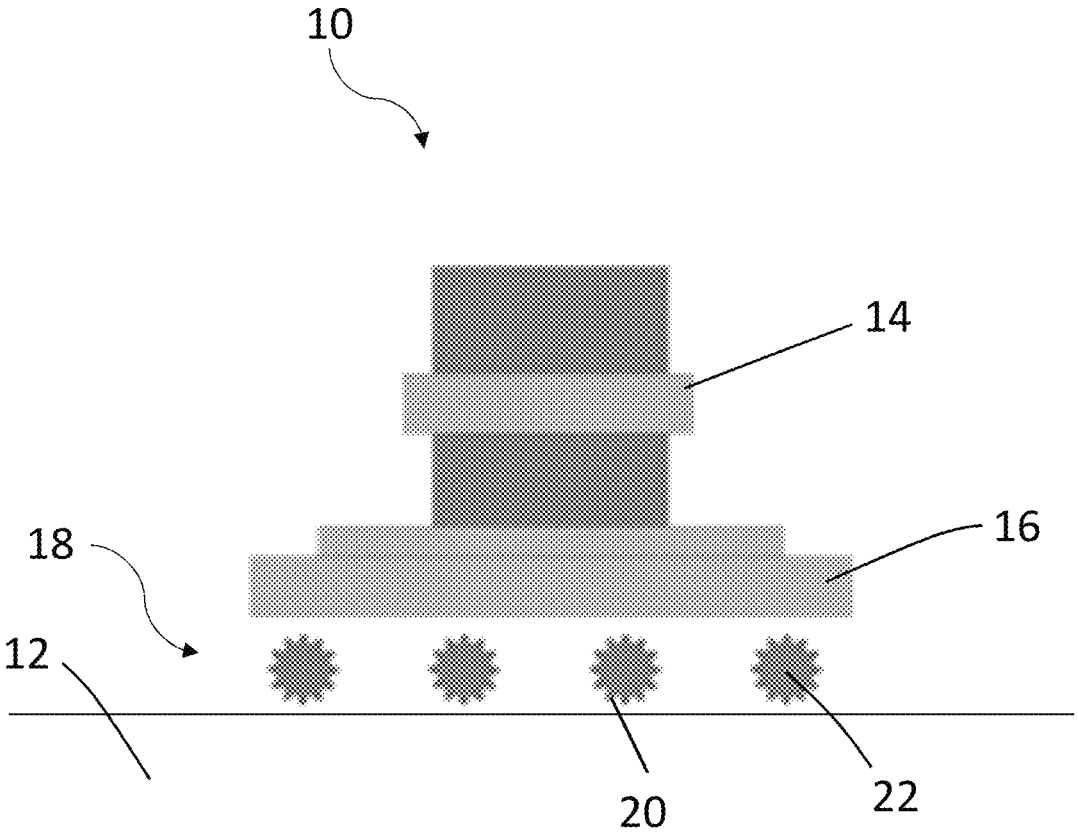
FIG. 1 is a schematic side view of an apparatus for heating a road surface according to an embodiment.

Referring firstly to FIG. 1, an apparatus 10 for heating a road surface 12 to be repaired is illustrated.

The heating apparatus 10 includes a frame 14. A heater 16 is connected to the frame 14. As is illustrated, the heater 16 is intended to be positioned over a road surface 12 so as to heat the material of the road surface 12. An agitator 18 is connected to the frame 14. The agitator 18 is arranged to extend into agitate loose material of the road surface 12 that has previously been broken up (e.g. by a milling device, as is discussed below). The agitator 18 is configured to agitate and mix loose material of the road surface 12 that has been heated by the heater 16 (e.g. during a heating process). It will be understood that prior to the breaking up of the road surface and/or the heating of said road surface, the road surface will be cleaned, e.g. using a sweeper. This sweeper may be provided as a separate component to the apparatus or may be connected thereto.

The heating apparatus 10 may be configured such that the agitator 18 agitates the material of the road surface 12 at the same time as the road surface 12 is being heated. Alternatively, the heating apparatus 10 may be configured to alternately heat the material of the road surface 12 and agitate said material.

This combination of heating and mixing of the material of the road surface 12 (either alternately or concurrently) has been found to reduce the time required to heat the material of the road surface 12 to the required temperature (typically around 150° C.).

In the embodiment, the heater 16 is an infrared heater, for example a gas powered infrared heater. This type of heater 16 has been found to increase the efficiency of the heating apparatus 10 due to directly heating the material mass and not the intervening air. It will be appreciated that different heaters may be used in alternative arrangements, such as convection heaters or microwave heaters.

The heater 16 may have an energy in the range of 200,000 BTU (211 MJ) to 2,000,000 BTU (2 GJ). In this way, the heating apparatus 10 is able to heat the material of a road surface 12 to a desired temperature (e.g. in the range of 50° C. to 200° C.) in the range of 30 second to three minutes (e.g. in less than a minute).

The heater 16 defines a heating area that is positioned over a road surface 12 during operation. The heating area is substantially rectangular or square having sides in the range of 0.3 m to 1.5 m, e.g. approximately 1 m, over which heat is applied to the material of the road surface 12.

Although not illustrated, the heating apparatus 10 may include a control system configured to control activation of the heater 16. The control system may be configured such that the heater 16 is either continuously activated during a heating process, or may be periodically activated.

The heating apparatus 10 may also include a sensor (not shown) for sensing the distance between the heater 16 and the road surface 12. In such arrangements, the control system may be configured to activate the heater 16 when the distance between the heater 16 and the road surface 12 is below a predetermined threshold.

In the embodiment, the agitator 18 for agitating the material of the road surface 12 is formed from a metallic material, e.g. stainless steel. It will be appreciated that the agitator may be formed from any suitable material in alternative arrangements.

The road surface 12, typically formed from asphalt, tends to stick to surfaces when it is at an ambient temperature. In order to mitigate this, the heating apparatus 10 is configured to heat the agitator 18 prior to interacting with the road surface 12 to reduce sticking of the road surface material to the agitator 18.

In the arrangement shown, the agitator 18 is positioned between (e.g. interposed between) the heater 16 and the road surface 12. This arrangement of the agitator 18 enables it to be heated by the heater 16 as it is heating the road surface 12. However, in alternative arrangements the agitator may not be interposed between the heater 16 and the road surface 12 and/or the heating apparatus may include an additional heating arrangement for heating the agitator 18 to the desired temperature.

As discussed above, the agitator 18 is configured to agitate material of a road surface 12 that has been broken up, e.g. via a milling device. It will be appreciated that the agitator 18 may be configured to agitate/mix material of the road surface 12 down to different depths, as required. These depths may be up to approximately up to 40 mm below an upper road surface 12, up to 120 mm below an upper road surface 12, or up to 160 mm below an upper road surface.

In order to agitate the road surface 12, the agitator 18 includes one or more teeth 20 configured and arranged to extend into the material of the road surface 12. When the agitator (e.g. the teeth 20) extends into and agitates the road surface 12, road surface material is moved from lower down up towards the upper road surface. This mixing of the layers of the road surface material during a heating process has been found to increase the efficiency of heating and reducing the required heating time. It will be appreciated that in alternative arrangements the agitator 18 may not include teeth and may be provided in the form of one or more paddles, or may be provided in the form of an auger, or any other suitable arrangement may be used.

In the illustrated embodiment, the teeth are provided on rotatable members 22 mounted to the frame 14. Each rotatable member 22 is configured to rotate relative to the frame 14 at a rate in the range of 5-100 RPM, e.g. at a rate in the range of 20-30 RPM. In the arrangement shown, the agitator 18 includes four rotatable members 22 arranged in array. This arrangement increases the area of the road surface 12 that is agitated during the heating process, such that substantially all of the area being heated is able to be agitated. It will be appreciated that any suitable number of rotatable members may be used such as one, two, three, five or more.

Although not illustrated, the agitator 18 may be moveable between first and second positions relative to the frame 14. In the first position, the agitator 18 is able to interact with the material of the road surface 12 material. In the second position, the agitator 18 is spaced apart from the material of the road surface 12. This configuration enables the heating apparatus to be transported with the agitator 18 in a raised or retracted position. Additionally, this arrangement enables an operator to heat the agitator 18 to a desired temperature, prior to engaging the agitator 18 with the road surface 12.

Figure 5:
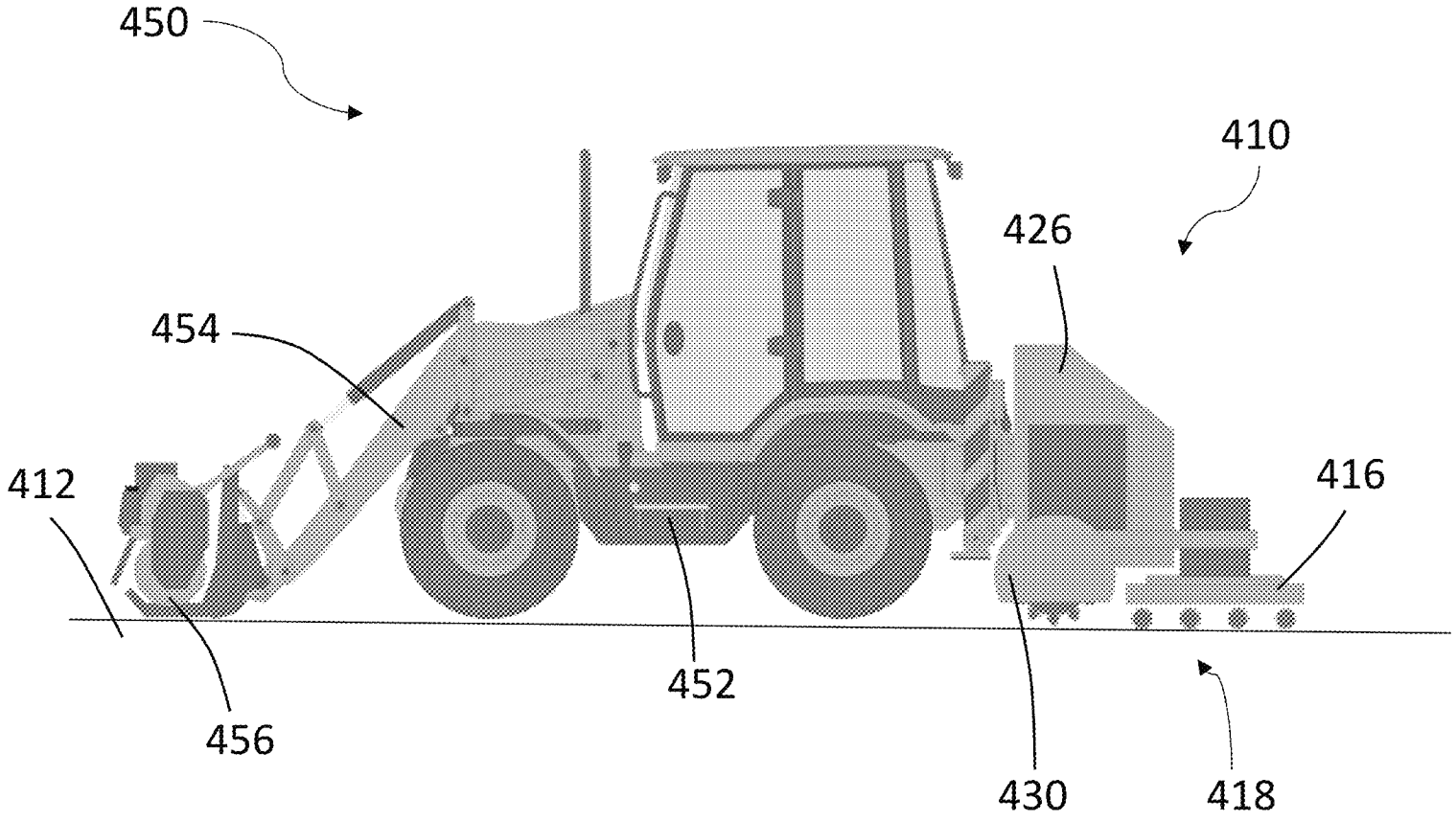
FIG. 5 is a schematic side view of a working machine according to an embodiment.
Figure 6:
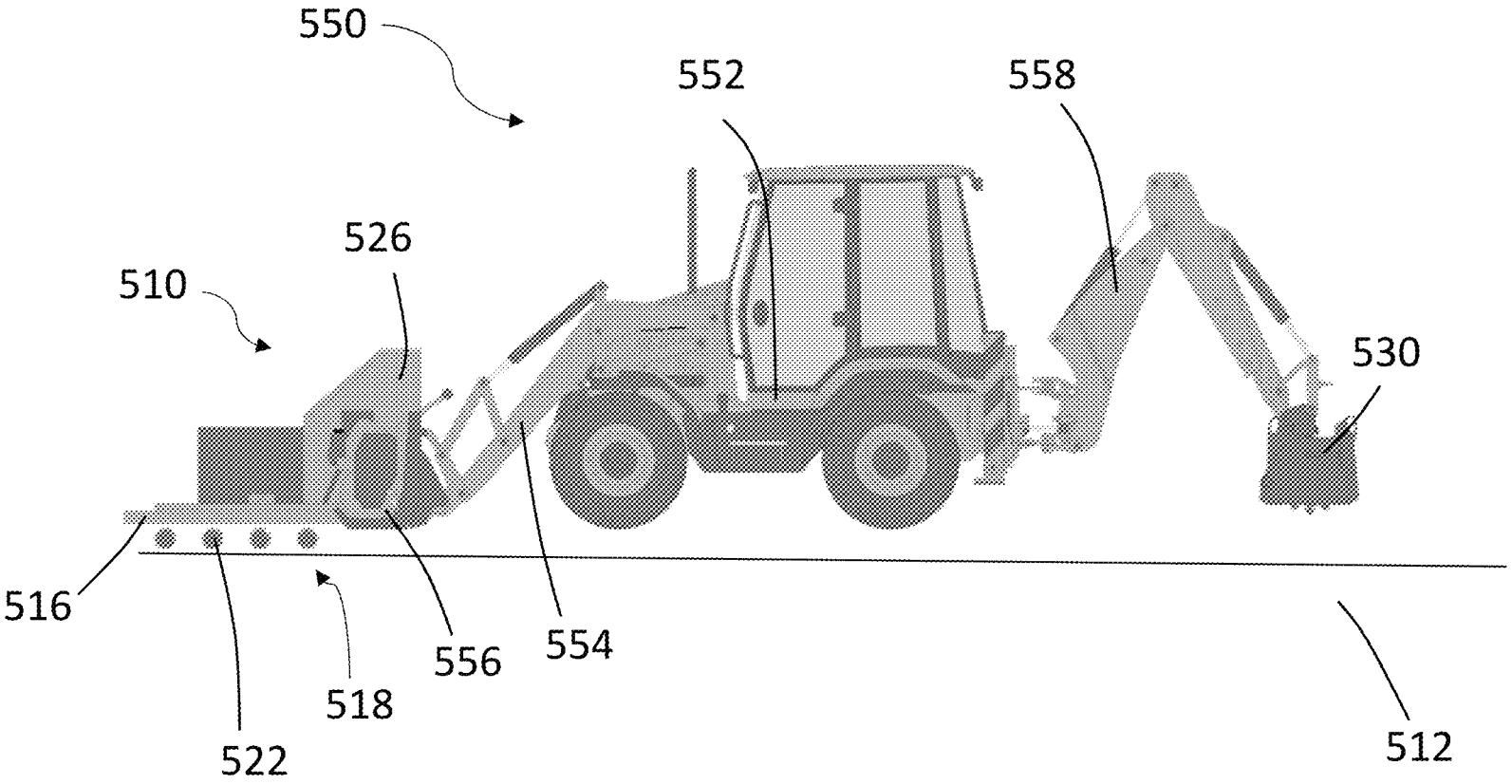
FIG. 6 is a schematic side view of a working machine according to an embodiment.

The heating apparatus 10 is intended to be portable, meaning that an operator is able to transport the heating apparatus 10 to the location of road surface 12 to be repaired. In the arrangement shown, the heating apparatus 10 includes a mounting arrangement (not shown) for mounting the heating apparatus 10 to a working machine (as is shown in FIGS. 5 and 6). In alternative arrangements, the heating apparatus may not include the mounting arrangement and instead may be moveable, for example on wheels, and transported to the location of the road surface 12 on a trailer or by other such means.

Operation of the heating apparatus 10 of FIG. 1 will now be discussed. In order to repair a road surface 12, the heating apparatus 10 is first moved to the desired location on the road surface 12, e.g. via a working machine, a trailer etc. The heater 16 of the heating apparatus 10 then applies heat to the road surface 12. The material of the road surface 12 is then agitated by the agitator 18 of the heating apparatus 10. This agitation of the road surface 12 may be carried out at the same time as the heating, or the material of the road surface may be heated and then agitated alternately. In some arrangements, prior to agitating the road surface 12, the agitator may be heated by the heating apparatus 10, e.g. by the heater 16. It will be appreciated that prior to heating, the road surface 12 to be repaired will have been broken up using a separate milling device (not shown).

Figure 2:
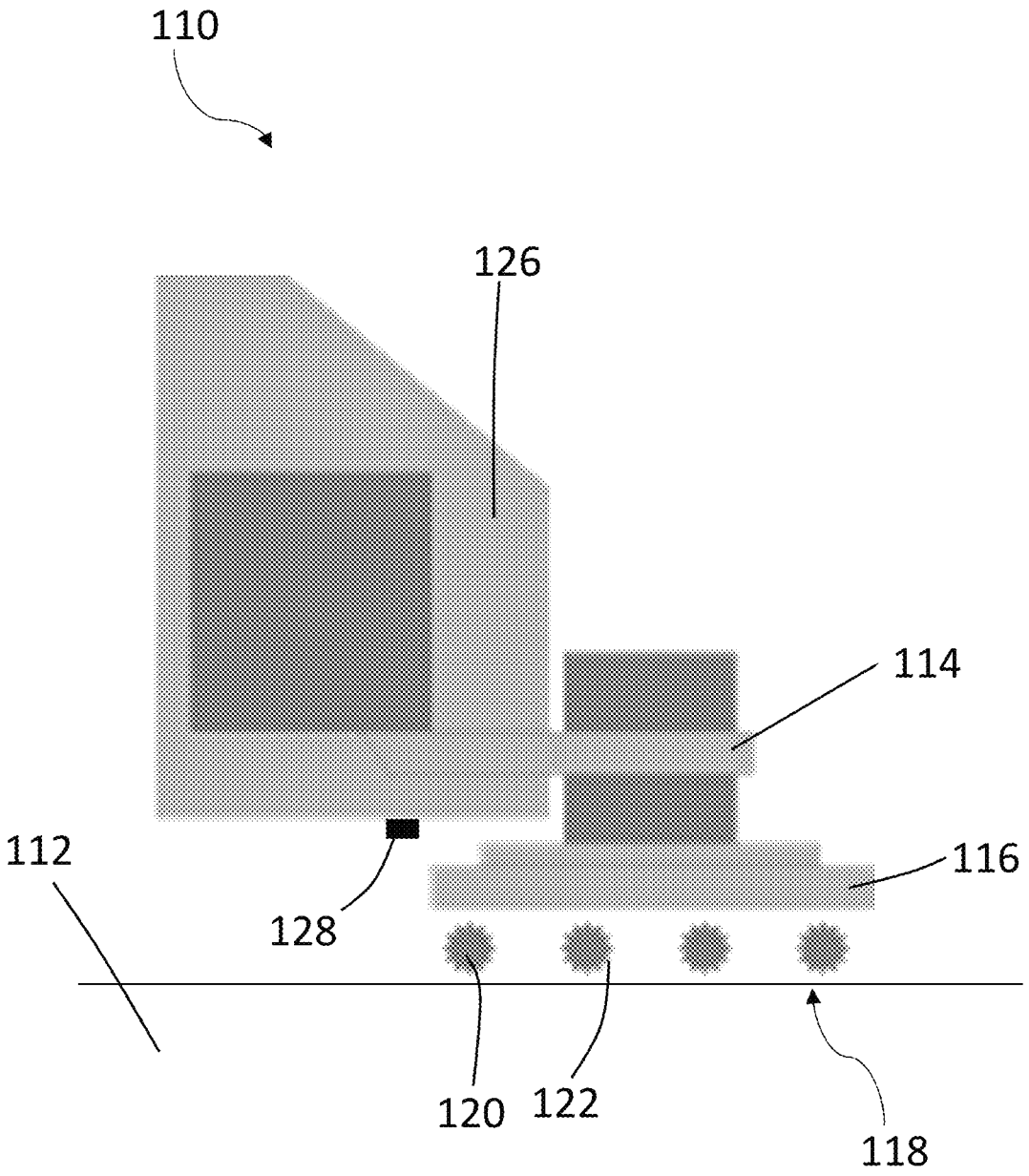
FIG. 2 is a schematic side view of an apparatus for heating a road surface according to an embodiment.

Referring now to FIG. 2, a heating apparatus 110 is illustrated. The heating apparatus 110 is similar to that described in relation to FIG. 1, but includes a receptacle 126 mounted to the frame 114. Corresponding components of FIG. 2 with respect to FIG. 1 are labelled with the prefix '1', and only differences are discussed.

The receptacle 126 mounted to the frame 114 is configured for storing replacement road surface material therein. In this arrangement, the receptacle 126 is configured to deposit the replacement road surface material onto the road surface 112 via a nozzle 128, after the road surface 112 has been heated and agitated by the heater 116 and agitator 118, respectively.

In some arrangements, the agitator 118 may be utilized to extend into and agitate the road surface 112 after the replacement road surface material has been deposited. This improves mixing of the existing and replacement road surface, which has been found to improve bonding of the repaired road surface area to the rest of the road. Through this agitation, the agitator is configured to substantially level the road surface area prior to compaction (e.g. with a roller, as is discussed below), which removes the need for a separate leveller to be used. In alternative arrangements, the heating apparatus 110 may be provided with a mixing member arranged to extend into and agitate the road surface 112 after the replacement road surface material has been deposited. It will be appreciated that the heating apparatus 110 may also be configured to heat the mixing member to reduce sticking of the road surface material thereto.

The heating apparatus 110 is intended to be portable, meaning that an operator is able to transport the heating apparatus 110 including the heater 116, agitator 118 and receptacle 126 to the location of road surface 112 to be repaired. The heating apparatus includes a mounting arrangement (not shown) for mounting the heating apparatus 110 to a working machine (as shown in FIGS. 5 and 6). In alternative arrangements, the heating apparatus 110 may not include the mounting arrangement and instead may be moveable, for example on wheels, and transported to the location of the road surface 112 on a trailer or by other such means.

Operation of the heating apparatus as illustrated in FIG. 2 will now be discussed. In order to repair a road surface 112, the heating apparatus 110 is first moved to the desired location on the road surface 112, e.g. via a working machine, a trailer etc. The heater 116 of the heating apparatus 110 then applies heat to the road surface 112. The material of the road surface 112 is then agitated by the agitator 118 of the heating apparatus 110. This agitation of the road surface 112 may be carried out at the same time as the heating, or the material of the road surface may be heated and then agitated alternately. In some arrangements, prior to agitating the road surface 112, the agitator may be heated by the heating apparatus 110, e.g. by the heater 116. Following the heating and agitating of the road surface 112, the heating apparatus 110 will deposit replacement road surface material from the receptacle 126 onto the road surface 112. This is carried out to ensure that the repaired road surface is level with the existing adjacent road surface. In some arrangements, the heating apparatus 110 may mix the replacement road surface material with the material of the road surface 12 that has previously been heated/agitated. It will be appreciated that prior to heating, the road surface 12 to be repaired will have been broken up using a separate milling device (not shown).

Figure 3:
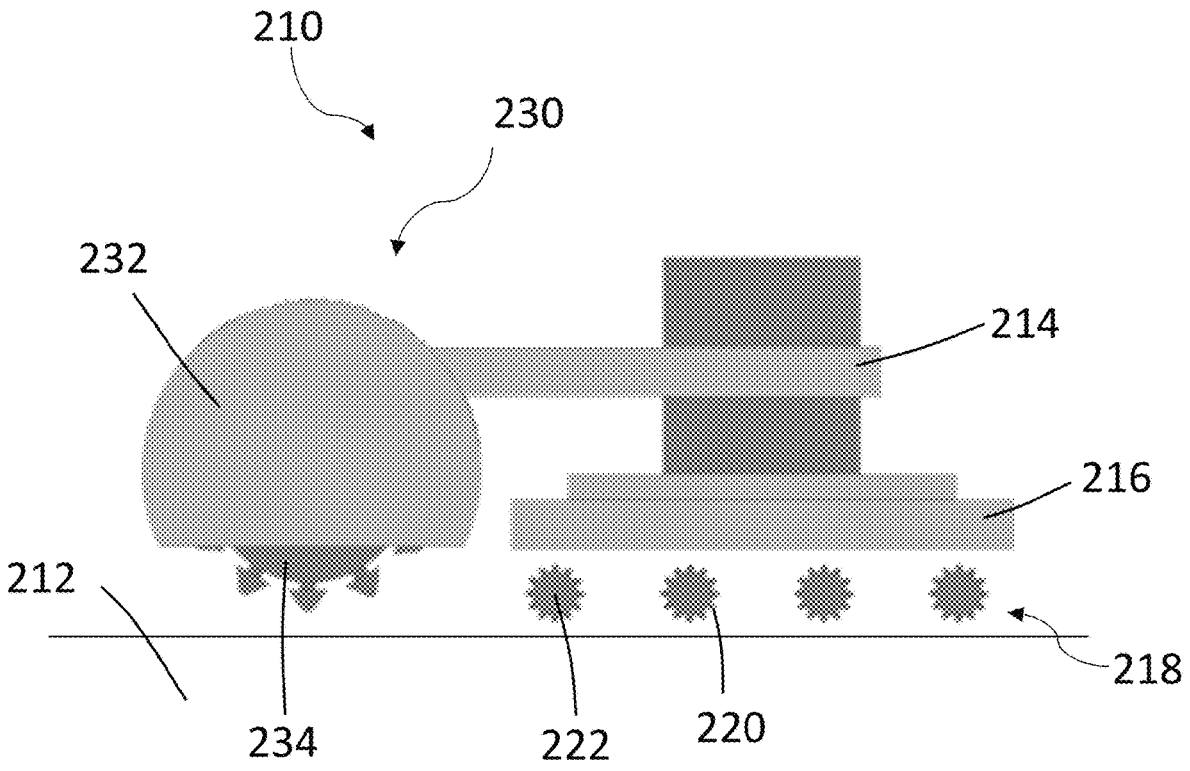
FIG. 3 is a schematic side view of an apparatus for heating a road surface according to an embodiment.

Referring now to FIG. 3, a heating apparatus 210 is illustrated. The heating apparatus 210 is similar to that described in relation to FIG. 1, but includes a milling device 230 connected to the frame 214 for breaking up a road surface 212. Corresponding components of FIG. 3 with respect to FIG. 1 are labelled with the prefix '2', and only differences are discussed.

The milling device 230 is provided for breaking up, e.g. milling, a road surface 312 to enable it to be subsequently agitated during a heating process. In the arrangement shown, the milling device 230 is provided in the form of a planer, but any device suitable for breaking up the road surface may be used.

The planer 230 includes a planer housing 232 and a milling drum 234 for breaking up a road surface 212. It will be appreciated that the planer 230 may be configured to break up a road surface 212 down to a depth of approximately 40 mm, or down to a depth of approximately 120 mm, or down to a depth of approximately 160 mm, as required.

When the road surface 212 has been broken up by the planer 230, the loose road surface material is left in place as loose debris. Following this process, the loose surface material is the heated and agitated, as has been discussed with reference to FIGS. 1 and 2.

The heating apparatus 210 is intended to be portable, meaning that an operator is able to transport the heating apparatus 210 including the heater 216, agitator 218 and planer 230 to the location of road surface 212 to be repaired. The heating apparatus includes a mounting arrangement (not shown) for mounting the heating apparatus 210 to a working machine (as is shown in FIGS. 5 and 6). In alternative arrangements, the heating apparatus 210 may not include the mounting arrangement and instead may be moveable, for example on wheels, and transported to the location of the road surface 212 on a trailer or by other such means.

Operation of the heating apparatus as illustrated in FIG. 3 will now be discussed. In order to repair a road surface 212, the heating apparatus 210 is first moved to the desired location on the road surface 212, e.g. via a working machine, a trailer etc. Using the planer 230, the material of the road surface 212 to be repaired is broken up (i.e. loosened) down to a required depth. The heater 216 of the heating apparatus 210 then applies heat to the loose road surface 212. The material of the road surface 212 is then agitated by the agitator 218 of the heating apparatus 210. This agitation of the road surface 212 may be carried out at the same time as the heating, or the material of the road surface may be heated and then agitated alternately. In some arrangements, prior to agitating the road surface 212, the agitator may be heated by the heating apparatus 210, e.g. by the heater 216.

Figure 4:
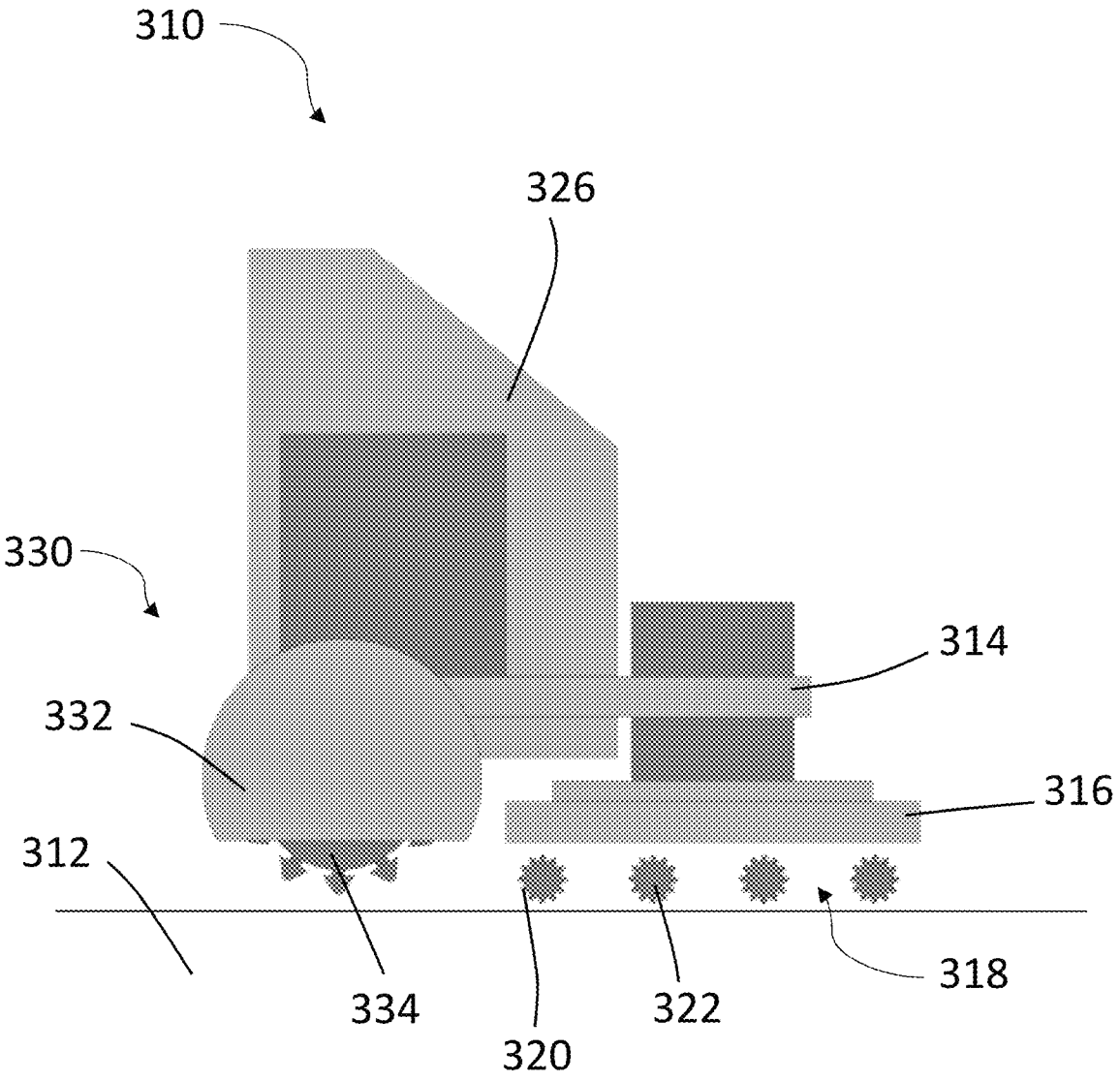
FIG. 4 is a schematic side view of an apparatus for heating a road surface according to an embodiment.

Referring now to FIG. 4, a heating apparatus 310 is illustrated. The heating apparatus 310 is similar to that described with reference to FIG. 1, but includes a milling device 330 and a receptacle 326 connected to the frame 314. Corresponding components of FIG. 4 with respect to FIGS. 1 to 3 are labelled with the prefix '3', and only differences are discussed.

The milling device 330 is provided for breaking up, e.g. milling, a road surface 312 to enable it to be subsequently agitated during a heating process. In the arrangement shown, the milling device 330 is provided in the form of a planer but any device suitable for breaking up the road surface may be used. The receptacle 326 mounted to the frame 314 is configured for storing replacement road surface material therein. The heating apparatus 310 illustrated in FIG. 4 provides a single unit that is able to: i) break up a road surface (in a similar manner as described for FIG. 3); ii) heat and agitate material of a road surface 312 (in a similar manner as has been described for FIG. 1); and iii) deposit replacement road surface material (in a similar manner as has been described for FIG. 3).

Operation of the heating apparatus as illustrated in FIG. 4 will now be discussed. In order to repair a road surface 312, the heating apparatus 310 is first moved to the desired location, e.g. via a working machine, a trailer etc. Using the planer 330, the material of the road surface 312 to be repaired is broken up (i.e. loosened) down to a required depth. The heater 316 of the heating apparatus 310 then applies heat to the loose road surface 312. The material of the road surface 312 is then agitated by the agitator 318 of the heating apparatus 310. This agitation of the road surface 312 may be carried out at the same time as the heating, or the material of the road surface may be heated and then agitated alternately. In some arrangements, prior to agitating the road surface 312, the agitator may be heated by the heating apparatus 310, e.g. by the heater 316. Following the heating and agitating of the road surface 312, the heating apparatus 310 will deposit replacement road surface material from the receptacle 326 onto the road surface 312. This is carried out to ensure that the repaired road surface is level with the existing adjacent road surface. In some arrangements, the heating apparatus 310 may mix the replacement road surface material with the material of the road surface 312 that has previously been heated/agitated, e.g. as the replacement road surface material is deposited.

Although not illustrated, each of the heating apparatus' 10, 110, 210, 310 illustrated in FIGS. 1 to 4 may further include a roller drum mounted to the frame. The roller drum being rotatable about an axis for travelling over and compacting the loose material of the road surface, in use.

Referring now to FIG. 5, a working machine 450 having a body 452 is illustrated. In the illustrated arrangement, the working machine is an excavator, but in alternative embodiments the working machine may be a construction vehicle such as a loader, a telehandler or the like. Corresponding components of FIG. 5 with respect to FIGS. 1 to 4 are labelled with the prefix '4', and only differences are discussed.

A first working arm 454 is connected to the body 452 for performing work functions. A roller drum 456 is mounted to the first working arm 454. The roller drum 456 is rotatable about an axis for travelling over and compacting a material of a road surface 412.

A heating apparatus 410 is mounted to the body 452. Although not illustrated, the heating apparatus 410 may be mounted to the body 452 via a second working arm. In the arrangement shown, the heating apparatus 410 mounted to the working machine 450 is similar to that illustrated in FIG. 4. That is the heating apparatus 410 includes a heater 416, an agitator 418, a milling device 430, and a receptacle 426 for replacement road material mounted to the frame 414.

Referring to FIG. 6, a working machine 550 having a body 552 is illustrated. In the illustrated arrangement, the working machine 550 is an excavator, but in alternative embodiments the working machine may be a construction vehicle such as a loader, a telehandler or the like. Corresponding components of FIG. 6 with respect to FIGS. 1 to 5 are labelled with the prefix '5', and only differences are discussed.

A first working arm 554 is connected to the body 552 for performing work functions. A heating apparatus 510 is mounted to the working arm 554. In the arrangement shown, the heating apparatus 510 mounted to the working machine 550 is similar to that illustrated in FIG. 5. That is the heating apparatus 510 includes a heater 516, an agitator 518, and a receptacle 526 for replacement road material mounted to the frame 514. However, in the illustrated arrangement, the heating apparatus 510 further includes a roller drum 556 is mounted to the frame 514. The roller drum 556 is rotatable about an axis for travelling over and compacting a material of a road surface 512.

A second working arm 558 is connected to the body 552 for performing work functions. A milling device 530 for breaking up a road surface 512 is mounted to the second working arm 558. The milling device 530 is provided for breaking up, e.g. milling, a road surface 512 to enable it to be subsequently agitated during a heating process. In the arrangement shown, the milling device 530 is provided in the form of a planer but any device suitable for breaking up the road surface may be used.

Operation of the working machines illustrated in FIG. 5 and FIG. 6 will now be discussed. In order to repair a road surface 412, 512, the working machine 450, 550 is first driven to the desired location. Using the planer 430, 530 the material of the road surface 412, 512 to be repaired is broken up (i.e. loosened) down to a required depth. The heater 416, 516 of the heating apparatus 410, 510 then applies heat to the loosened road surface 412, 512. The material of the road surface 412, 512 is then agitated by the agitator 418, 518 of the heating apparatus 410, 510. This agitation of the road surface 412, 512 may be carried out at the same time as the heating, or the material of the road surface may be heated and then agitated alternately. In some arrangements, prior to agitating the road surface 412, 512, the agitator may be heated by the heating apparatus 410, 510, e.g. by the heater 416, 516. Following the heating and agitating of the road surface 412, 512, the heating apparatus 410, 510 will deposit replacement road surface material from the receptacle 426, 526 onto the road surface 412, 512. This is carried out to ensure that the repaired road surface is level with the existing adjacent road surface. In some arrangements, the heating apparatus 410, 510 may mix the replacement road surface material with the material of the road surface 412, 512 that has previously been heated/agitated, e.g. as the replacement road surface material is deposited.

Although the invention has been described above with reference to one or more preferred embodiments, it will be appreciated that various changes or modifications may be made without departing from the scope of the invention as defined in the appended claims.

The invention claimed is:

1. A working machine comprising:

a body; and a first working arm connected to the body for performing work functions; and a second working arm connected to the body for performing work functions;

wherein an apparatus for heating a road surface material to be repaired is mounted to the first working arm, the apparatus comprising a frame, a heater for heating the road surface material and connected to frame such that it opposes the road surface material to be heated, in use, an agitator connected to the frame, the agitator configured to agitate the road surface material to be heated, and a milling device connected to the frame, the milling device configured for breaking up a road surface, wherein, in use, the apparatus is configured such that the agitator is configured to agitate the road surface material as the heater is heating said road surface material; and wherein a roller drum is mounted to the second working arm, the roller drum in use being rotatable about an axis for travelling over and compacting the road surface material.

2. The working machine according to claim 1, wherein the apparatus comprises a receptacle for storing replacement road surface material and wherein the receptacle is configured to deposit said replacement road surface material onto the road surface.

3. The working machine according to claim 1, wherein the working machine is an excavator, a loader, or a telehandler.

4. The working machine according to claim 1, wherein the agitator is arranged to be interposed between the heater and the road surface, in use, such that the heater is configured to heat the agitator and the road surface material.

5. The working machine according to claim 1, wherein the agitator is connected to the frame so as to be moveable between a first position in which the agitator is able to interact with the road surface material, in use, and a second position in which the agitator is spaced apart from, and unable to interact with, the road surface material.

6. The working machine according to claim 1, wherein the heater defines a heating area over which heat is applied to the road surface material, in use, and wherein the one or more rotatable members are arranged in an array over said heating area.

7. The working machine according to claim 1, wherein the milling device is configured to break up the road surface down to a depth of up to 160 mm below an upper road surface.

8. The working machine according to claim 1, wherein the milling device comprises a planer connected to the frame.

9. The working machine according to claim 1, comprising a control system configured to control activation of the heater, wherein the control system is configured to activate the heater periodically.

10. The working machine according to claim 1, comprising a control system configured to control activation of the heater and a sensor for sensing the distance between the heater and the road surface, in use, wherein the control system is configured to activate the heater when the distance between the heater and the road surface is below a predetermined threshold.

11. The working machine according to claim 1, and further comprising a vibration assembly arranged to impart a vibratory force to the roller drum, in use.

12. The working machine according to claim 1, wherein the apparatus is configured to agitate the deposited replacement road surface material and the road surface material, in use.

13. The working machine according to claim 12, wherein the agitator is configured to agitate the deposited replacement road surface material and the road surface material, in use.

* * * * *